US008131182B2

(12) United States Patent
Mizuno et al.

(10) Patent No.: US 8,131,182 B2
(45) Date of Patent: Mar. 6, 2012

(54) IMAGING CARTRIDGE AND IMAGE FORMING APPARATUS

(75) Inventors: Hiroshi Mizuno, Aisai (JP); Isamu Kugimiya, Toyokawa (JP); Takeshi Hashimoto, Okazaki (JP); Naoto Yoshida, Toyokawa (JP); Nozomu Kondo, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 757 days.

(21) Appl. No.: 12/197,628

(22) Filed: Aug. 25, 2008

(65) Prior Publication Data

US 2009/0060570 A1 Mar. 5, 2009

(30) Foreign Application Priority Data

Aug. 31, 2007 (JP) ..... 2007-225278

(51) Int. Cl.
*G03G 15/08* (2006.01)

(52) U.S. Cl. ..... 399/120

(58) Field of Classification Search ..... 399/111–114, 399/120, 103, 106
See application file for complete search history.

(56) References Cited

U.S. PATENT DOCUMENTS

| | | | | |
|---|---|---|---|---|
| 5,479,247 | A * | 12/1995 | Watanabe et al. | 399/120 |
| 6,363,233 | B1 * | 3/2002 | Nakajima | 399/120 |
| 7,426,356 | B2 * | 9/2008 | Ota | 399/120 |

FOREIGN PATENT DOCUMENTS

| | | |
|---|---|---|
| JP | 8-15971 | 1/1996 |
| JP | 2000-275944 | 10/2000 |
| JP | 2002-268356 | 9/2002 |
| JP | 2005-107141 | 4/2005 |

OTHER PUBLICATIONS

Japanese Notification of Reasons for Refusal mailed on Aug. 25, 2009, directed to counterpart Japanese Patent No. 2007-225278; 7 pages.

* cited by examiner

*Primary Examiner* — David Gray
*Assistant Examiner* — Gregory H Curran
(74) *Attorney, Agent, or Firm* — Morrison & Foerster LLP

(57) ABSTRACT

An imaging cartridge has a process unit and a toner box unit formed by integrating a new toner box and a waste toner box. The toner box unit is attachable to and detachable from the process unit. Shutters which open and close a connecting section between the new toner box and a developing device included in the process unit can be opened by manual operation when the toner box unit is attached to the process unit. Shutters and which open and close a connecting section between a cleaning device included in the process unit and the waste toner box are opened when the imaging cartridge is in the process of being moved to a prescribed position in an apparatus body.

12 Claims, 14 Drawing Sheets

IMAGING CARTRIDGE AND IMAGE FORMING APPARATUS

RELATED APPLICATION

This application based on Japanese Patent Application No. 2007-225278 the contents in which are incorporated herein by reference.

BACKGROUND OF THE INVENTION

The present invention relates to an imaging cartridge used for image forming apparatuses such as copying machines, facsimile machines, printers, and multi-functional machines.

For enhancing maintenanceability, an imaging cartridge has been known which can be loaded into and unloaded from an image forming apparatus body by providing such devices as an image bearing body, a charging device, a developing device, a transfer device, a cleaning device in the form of cartridges (see, e.g., Japanese Patent Application Laid-Open Publications 2002-268356 and 2005-107141). In this kind of imaging cartridge, with respect to a new toner box for storing unused toner to be fed to the developing device and a waste toner box for storing waste toner collected by the cleaning device, the following two aspects are generally known.

In the first aspect, the new toner box and waste toner box are consumable items independent of the imaging cartridge. In the second aspect, both of the new toner box and waste toner box are integrated with the imaging cartridge.

However, the first aspect increases the number of consumable items, resulting in complicated replacement procedures. Further, the second aspect requires replacement of the imaging cartridge for such reasons as exhaustion of the toner in the new toner box (toner empty) and the waste toner filling of the waste toner box (waste toner full) even if expensive components included in the imaging cartridge have not yet expired in life, thereby causing increase in total cost for ownership (TCO).

In order to solve these problems, it would be conceivable that the imaging cartridge is so structured that the new toner box and waste toner box are integrated with each other and are made detachable from the imaging cartridge so as to achieve both of the simplification of consumable item replacement procedures and the reduction in TCO. In the case of adopting this structure, it is necessary, with respect to the new toner box, to promptly feed toner to a predetermined section to the developing device. Further, with respect to the waste toner box, it is necessary to certainly prevent the leakage and scattering of toner during loading into and unloading from the image forming apparatus body.

However, those issues have not been addressed in the conventional imaging cartridges including those disclosed in Japanese Patent Application Laid-Open Publications 2002-268356 and JP 2005-107141. For example, Japanese Patent Application Laid-Open Publications 2002-268356 and JP 2005-107141 merely disclose, with respect to the new toner box detachable from the imaging cartridge, a mechanism for ensuring opening and closing of a shutter provided at a delivery opening to deliver toner to the developing device.

SUMMARY OF THE INVENTION

Accordingly, an object of the present invention is to provide an imaging cartridge having a new toner box and waste toner box integrated to each other and made detachable so as to achieve prompt feeding of toner from the new toner box to a developing device and reliable prevention of leakage and scattering of the toner from the waste toner box.

A first aspect of the present invention provides an imaging cartridge detachably loaded into an image forming apparatus body, comprising a process unit comprising at least an image bearing body, a developing device for developing an electrostatic latent image on the image bearing body to form a toner image, and a cleaning device for collecting toner remaining on the image bearing body after transfer of the toner image, a toner box unit integrally comprising a new toner box for storing unused toner to be fed to the developing device and a waste toner box for storing waste toner collected by the cleaning device, the toner box unit being detachably attached to the process unit, a first shutter mechanism movable to a close position which blocks movement of the toner through a first connecting section between the new toner box and developing device and an open position which permits the movement of the toner through the first connecting section, a second shutter mechanism movable to a close position which blocks movement of the toner through a second connecting section between the waste toner box and cleaning device and an open position which permits the movement of the toner through the second connecting section, a first shutter drive mechanism adapted to enable the first shutter mechanism to be moved between the close position and open position by manual operation when the process unit with the toner box unit attached thereto is out of the image forming apparatus body, and a second shutter drive mechanism for moving the second shutter mechanism from the close position to the open position during movement of the process unit with the toner box unit attached thereto to a predetermined position in the image forming apparatus or after completion of the movement to the predetermined position.

Since the imaging cartridge is a toner replenishment type cartridge in which the toner box unit formed by integrating the new toner box and the waste toner box is detachably attached to the process unit, the process unit generally including expensive components can be used as long as possible, thereby achieving reduction in TCO.

Moreover, since the toner box unit formed by integrating the new toner box and waste toner box is detachably attached to the process unit, the attaching and detaching procedures of the new toner box and the waste toner box, which are consumable items, with respect to the image forming apparatus body are simple and easy to understand.

Further, the first shutter mechanism at the first connecting section between the new toner box and developing device can be moved by the first shutter drive mechanism to the open position by manual operation when the process unit with the toner box unit attached thereto is out of the image forming apparatus body, so that toner starts to move from the new toner box to the developing device through the first connecting section before loading of the imaging cartridge into the image forming apparatus body is completed. This results in reduction of the time to replenish the developing device with toner after loading the imaging cartridge into the image forming apparatus body.

Furthermore, the second shutter mechanism at the second connecting section between the waste toner box and the cleaning device is moved by the second shutter drive mechanism from the close position to the open position during movement of the imaging cartridge to a predetermined position in the image forming apparatus or after completion of the movement to the prescribed position. This ensures prevention of leakage and scattering of the toner from the waste toner box during loading and unloading of the imaging cartridge with respect to the image forming apparatus body.

A second aspect of the present invention provides an image forming apparatus including the above-mentioned imaging cartridge.

According to the imaging cartridge of the present invention, in addition to the simplification of the replacement procedures of the new toner box and waste toner box as consumable items, it becomes possible to reduce the time to replenish the developing device with toner after loading of the imaging cartridge into the image forming apparatus body as well as to ensure prevention of leakage and scattering of the toner from the waste toner box during loading and unloading of the imaging cartridge with respect to the image forming apparatus body.

BRIEF DESCRIPTION OF THE DRAWINGS

Other objects and characteristics of the present invention shall be clarified by the following description on the preferred embodiments with reference to the accompanying drawings.

DETAILED DESCRIPTION OF THE INVENTION

Figure 1:
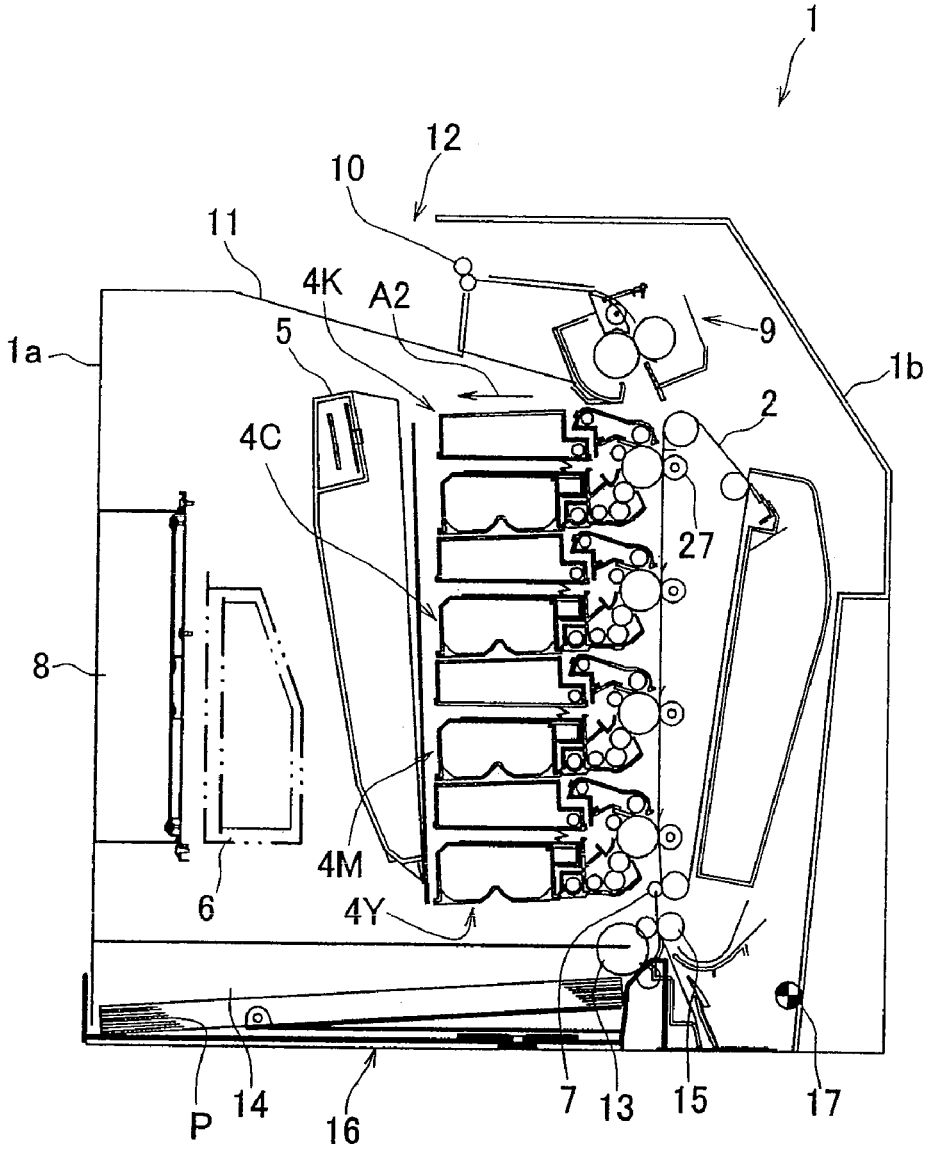
FIG. 1 is a cross sectional view showing an image forming apparatus including an imaging cartridge according to an embodiment of the present invention.

FIG. 1 shows an image forming apparatus (tandem-type color laser printer) 1 having an imaging cartridge according to an embodiment of the present invention. In the accompanying drawings, X axis direction denotes an anteroposterior direction of the image forming apparatus 1, Y axis direction denotes a width direction of the image forming apparatus 1 which is perpendicular to the X axis direction, and Z axis direction denotes a height direction of the image forming apparatus 1.

Figure 2:
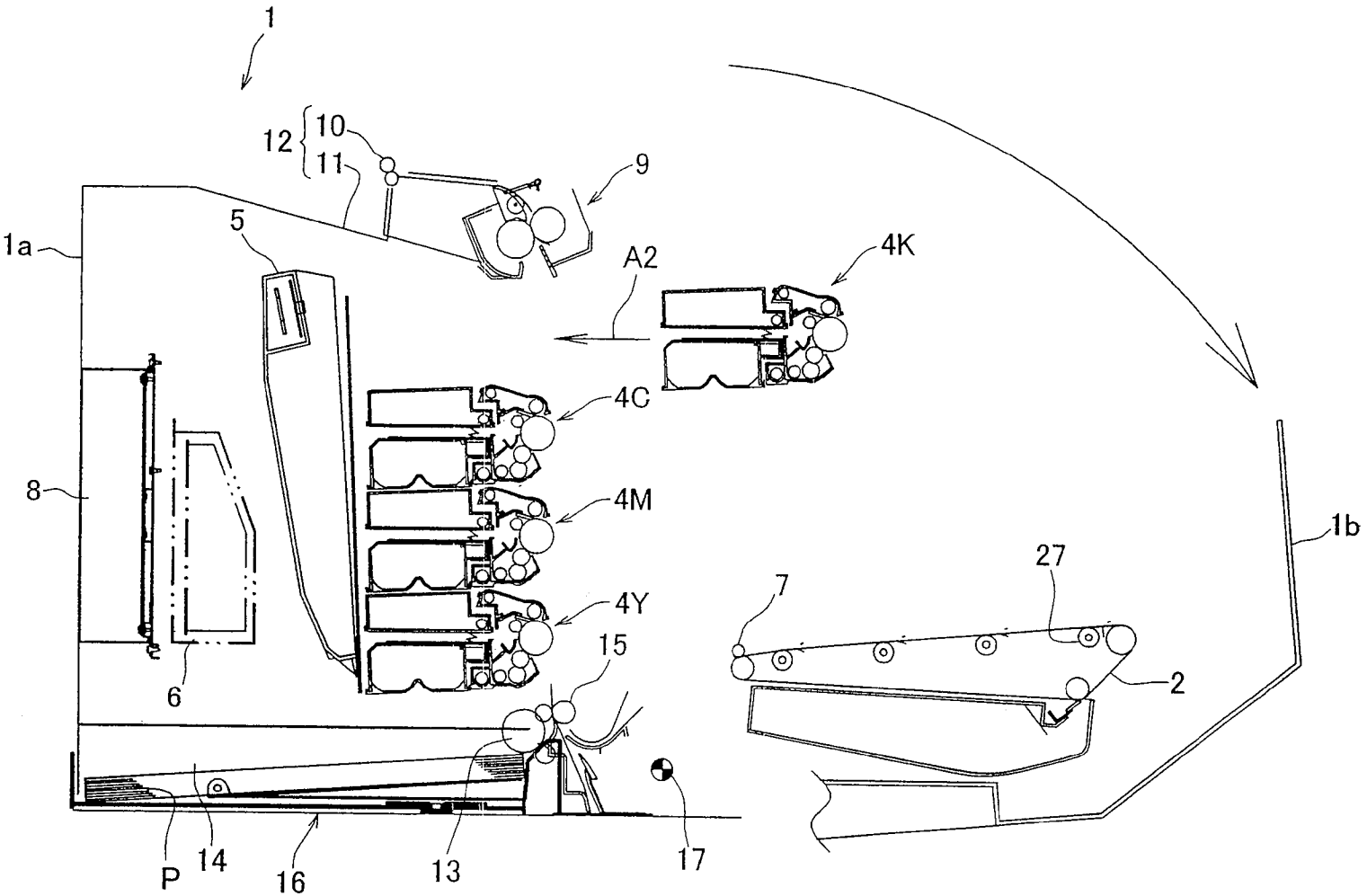
FIG. 2 is a cross sectional view showing the image forming apparatus with a door opened.

Arranged inside an apparatus main frame 1*a* of the image forming apparatus 1 is a transfer belt 2 stretched over a plurality of rollers. Also in the apparatus main frame 1*a*, four imaging cartridges 4Y, 4M, 4C and 4K of yellow, magenta, cyan and black are arranged in the longitudinal direction on a rear-face side of the apparatus main frame 1*a* (left-hand side in FIG. 1) with respect to the transfer belt 2. Further, accommodated in the apparatus main frame 1*a* on a further rear-face side from the imaging cartridges 4Y to 4K are, a laser exposure device 5, an electric power unit 6 for supplying electric power to the entire apparatus, and a control device 8 for controlling operation of each section. Placed on an upper side of the apparatus main frame 1*a* are a fixing device 9 and a paper ejection device 12 composed of a paper ejection roller 10 and a paper ejection tray 11. A sheet feeding device 16 having a paper cassette 14 and a feed roller 18 is arranged on a lower side of the apparatus main frame 1*a*. The paper cassette 14 can be attached to and detached from a front-face side of the apparatus main frame 1*a* (right-hand side in FIG. 1). A door 1*b* which can be rotated around a pivot 17 so as to be openable and closable is provided on the front-face side of the apparatus main frame 1*a*, and the transfer belt 2 is placed in the door 1*b*. As shown in FIG. 2, as the door 1*b* is opened, the transfer belt 2 is put in a escape position, where the imaging cartridges 4Y to 4K can be loaded into and unloaded from the front-face side of the apparatus main frame 1*a*.

Figure 3:
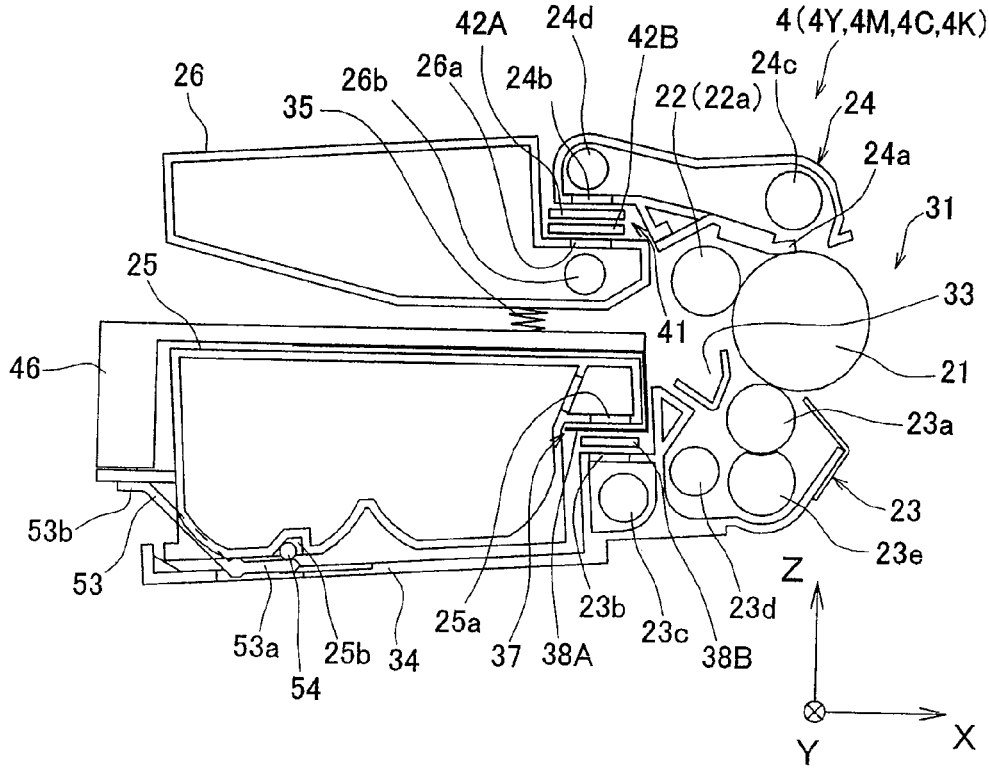
FIG. 3 is a cross sectional view showing the imaging cartridge according to the embodiment of the present invention.

Also with reference to FIG. 3, each of the imaging cartridges 4Y to 4K is provided with a cylindrical photoconductor (image bearing body) 21 provided in a rotatable manner as well as a charging device 22, a developing device 23, and a cleaning device 24 which are arranged around the photoconductor 21. Moreover, each of the imaging cartridges 4Y to 4K is provided with a new toner box 25 for storing unused toner and a waste toner box 26 for storing waste toner arranged above the new toner box 25. Toner corresponding to one among yellow, magenta, cyan, and black is stored in the new toner box 25 of each of the imaging cartridges 4Y to 4K. The transfer device 27 is arranged so as to face the photoconductor 21 of each of the imaging cartridges 4Y to 4K across the transfer belt 2 (see FIGS. 1 and 2).

Brief description is now given of the process in each of the imaging cartridges 4Y to 4K. First, the photoconductor 21 is charged by the charging device 22, and then is irradiated with a laser beam from the laser exposure device 5 to form an electrostatic latent image on the photoconductor 21 according to image signals. With the toner fed from the new toner box 25, the developing device 23 develops the electrostatic latent image on the photoconductor 21 to form a toner image. Toner that remains on the photoconductor 21 even after transfer of the toner image to a paper sheet or recording medium "P" by the transfer device 27 is collected by the cleaning device 24 and stored in the waste toner box 26.

The image forming apparatus 1 is a type in which the recording medium "P" is fed from the paper sheet cassette 14 to the front-face side and transported upward with an image being formed thereon meanwhile, and then discharged to the rear-face side. More specifically, the recording medium "P" is sent out from the paper sheet cassette 14 to the front-face side sheet by sheet by the feed roller 13, electrostatically held by the transfer belt 2 after passing through a timing roller 15 and conveying roller 7, and then transported upward. Whenever the recording medium "P" passes between the photoconductor 21 and the transfer device 27 in each of the imaging cartridges 4Y to 4K, a toner image of one color is electrostatically transferred thereon. The recording medium "P" with toner images transferred thereon in superimposition one on another by the imaging cartridges 4Y to 4K is transported to the fixing device 9 for fixing the toner image by heating and pressurization, and then the recording medium "P" is discharged by the paper ejection roller 10 to the paper ejection tray 11.

Description is now given of the imaging cartridges 4Y to 4K in detail. Hereinafter, when it is not necessary to distinguish four imaging cartridges 4Y to 4K, reference numeral "4" is used to denote the imaging cartridge.

Figure 4:
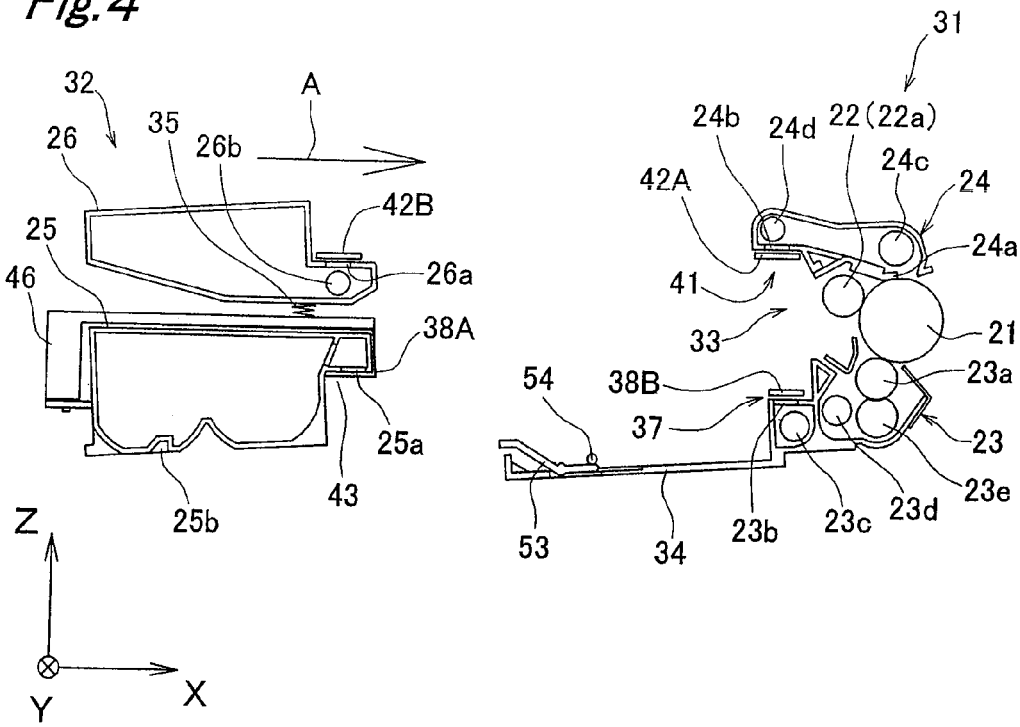
FIG. 4 is an exploded cross sectional view showing the imaging cartridge according to the embodiment of the present invention.
Figure 5:
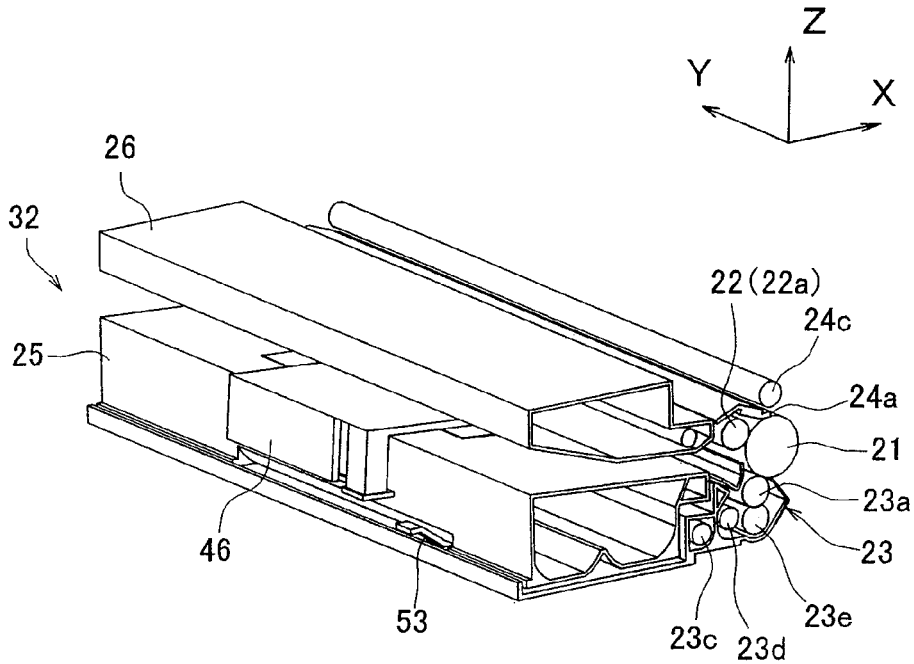
FIG. 5 is a perspective view showing the imaging cartridge according to the embodiment of the present invention.
Figure 6:
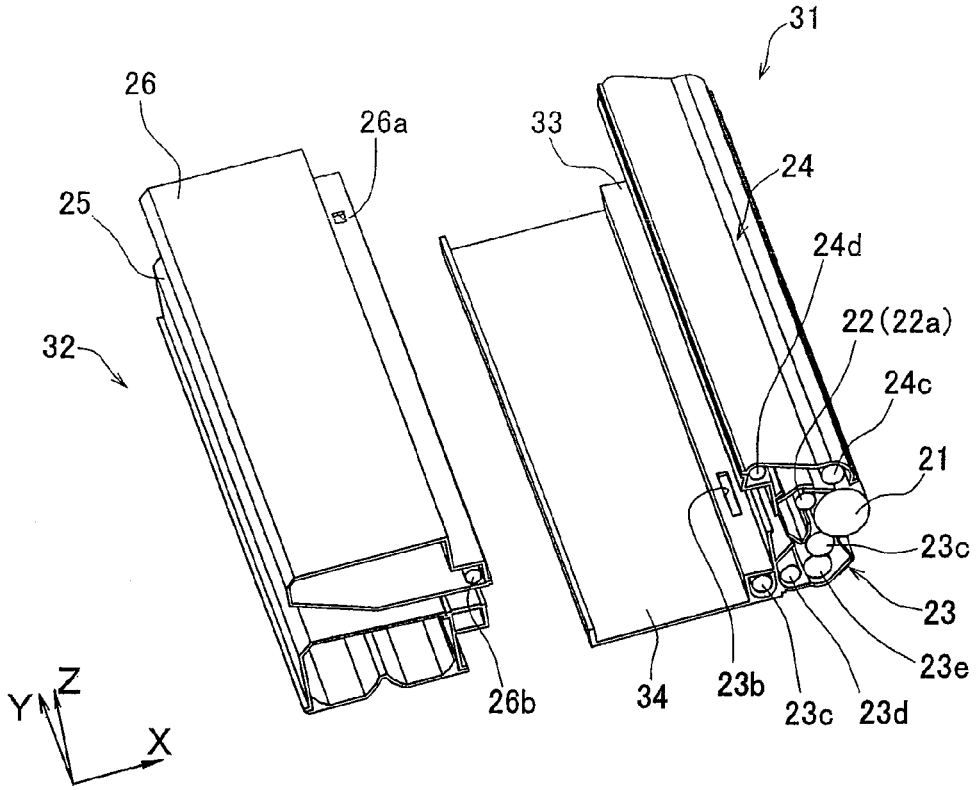
FIG. 6 is an exploded perspective view showing the imaging cartridge according to the embodiment of the present invention.

With reference to FIG. 3 through FIG. 5, the imaging cartridge 4 of the present embodiment comprises a process unit 31 and toner box unit 32. The toner box unit 32 is detachably attached to the process unit 31.

The process unit 31 comprises the photoconductor 21, charging device 22, developing device 23, and cleaning device 24. The cleaning device 24 comprises a cleaning blade 24*a* for collecting toner from the surface of the photoconductor 21, a waste side toner delivery opening 24*b* provided in a position away from the photoconductor 21 and opened downward, and a conveying roller 24*c* and conveying screw 24*d* for transporting the toner collected by the cleaning blade 24*a* to the waste side toner delivery opening 24*b*. The charging device 22 has a charging roller 22*a* for charging. The developing device 23 comprises a developing roller 23*a*, development side toner reception opening 23*b* provided in a position away from the developing roller 23*a* and opened upward, and a conveying screw 23*c* and conveying rollers 23*d*, 23*e* for transporting toner from the development side toner reception opening 23*b* to the developing roller 23*a*.

As most clearly shown in FIGS. 3 and 4, a reception space 33 is provided in a portion of the process unit 31 on its one side opposite to the photoconductor 21. The reception space 33 is a horizontally long space with its upper end being defined by a portion near the waste side toner delivery opening 24*b* of the cleaning device 24, and its lower end being defined by a portion near the development side toner reception opening 23*b* of the developing device 23. The process unit 32 also includes a pedestal section 34 which projects from the developing device 23 toward its one side opposite to the photoconductor 21 at a position lower than the reception space 33.

The toner box unit 32 is composed of a new toner box 25 and a waste toner box 26 which are detachably attached to the process unit 31. The new toner box 25 and the waste toner box 26 are integrally coupled to each other in a manner allowing elastic relative displacement by a helical compression spring 35. Since the imaging cartridge 4 is formed as a toner replenishment type cartridge in which the new toner box 25 and the waste toner box 26 can be attached to and detached from the process unit 31, the process unit 31 generally including expensive components can be used as long as possible, thereby allowing reduction in TCO. Moreover, since the new toner box 25 and the waste toner box 26 are detachably attached to the process unit 31, the attaching and detaching procedures of the new toner box 25 and the waste toner box 26, which are consumable items, to/from the image forming apparatus body 1*a* are simple and easy to understand.

Figure 11A:
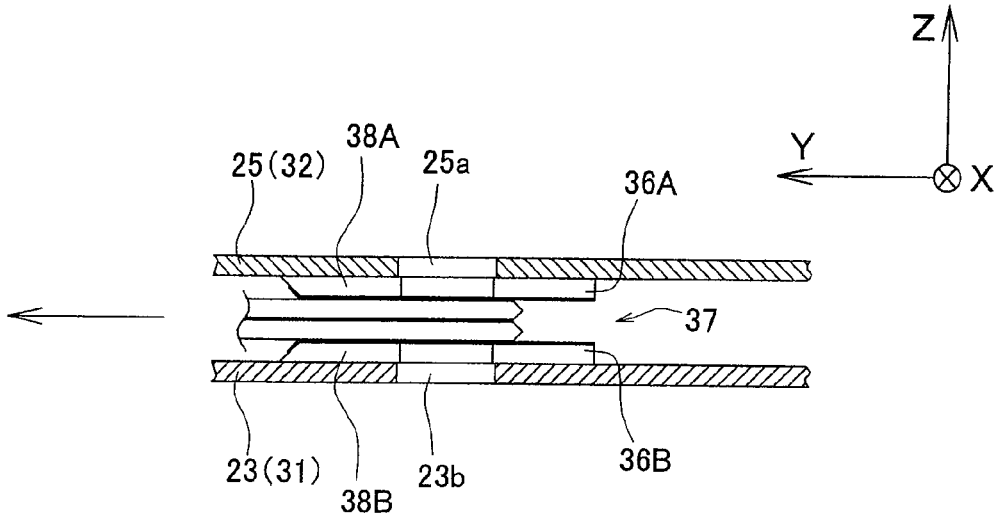
FIG. 11A is a partial sectional view showing a connecting section of the new toner box and developing device when the shutters of the new toner box and developing device are in a close position.
Figure 11B:
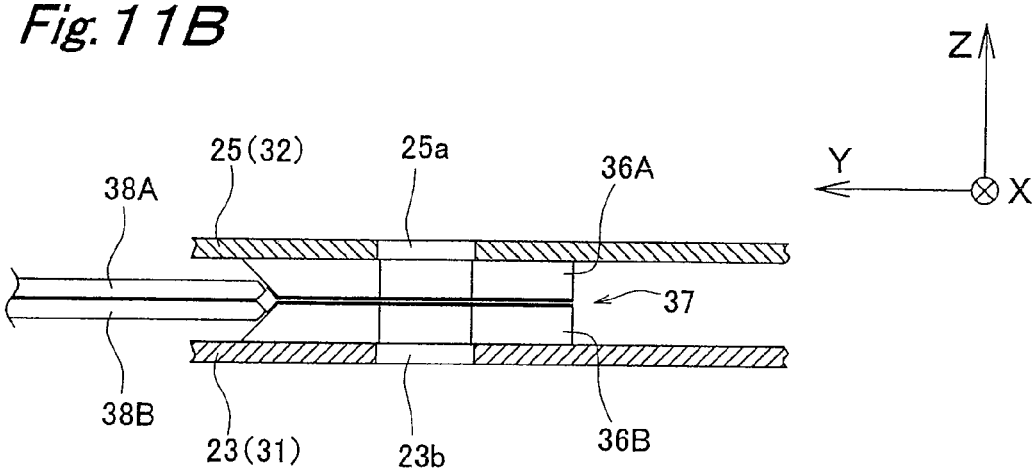
FIG. 11B is a partial sectional view showing the connecting section of the new toner box and developing device when the shutters of the new toner box and the developing device are in a close position.

The new toner box 25 is a box for storing therein unused toner fed to the developing device 23. The new toner box 25 has a development side toner delivery opening 25*a* opened downward in a region positioned above the development side toner reception opening 23*b* of the developing device 23 at the time of its attachment to the process unit 31. An unshown conveying screw is placed near the upper side of the development side toner delivery opening 25*a*. With reference to FIGS. 11A and 11B, the development side toner delivery opening 25*a* and the development side toner reception opening 23*b* each have a through hole formed therein, and are also equipped with elastically deformable sealing members 36A and 36B made of materials such as urethane. Moreover, PET films are stuck on apical surfaces of the sealing members 36A and 36B. In the state that the toner box unit 32 is attached to the process unit 31, the development side toner delivery opening 25*a*, the development side toner reception opening 23*b*, and the sealing members 36A and 36B function as a connecting section 37 which is a passage of the toner from the new toner box 25 to the developing device 23.

The new toner box 25 includes a shutter (new toner box side shutter) 38A which opens and closes the development side toner delivery opening 25*a*. Similarly, the process unit 32 includes a shutter (developing device side shutter) 38B which opens and closes the development side toner reception opening 23*b* of the developing device 23. By retracting these shutters 38A and 38B from between the sealing member 36A and 36B, the connecting section 37 can be opened so that the development side toner delivery opening 25*a* and the development side toner reception opening 23*b* is communicated with each other. The shutters 38A and 38B as well as the mechanism for driving these shutters will be described in detail later.

Figure 14A:
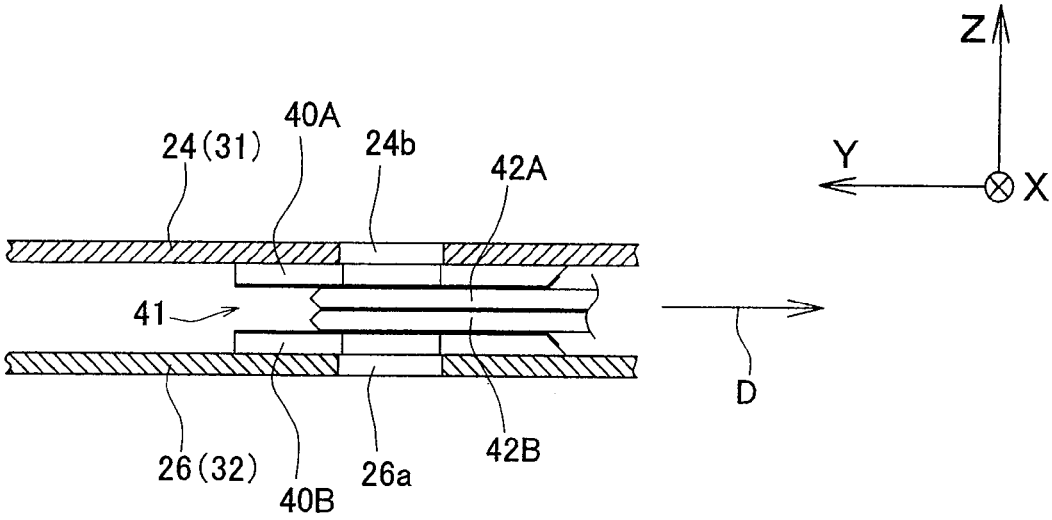
FIG. 14A is a partial sectional view showing the connecting section of the waste toner box and the cleaning device when the shutters of the cleaning device and waste toner box are in a close position.
Figure 14B:
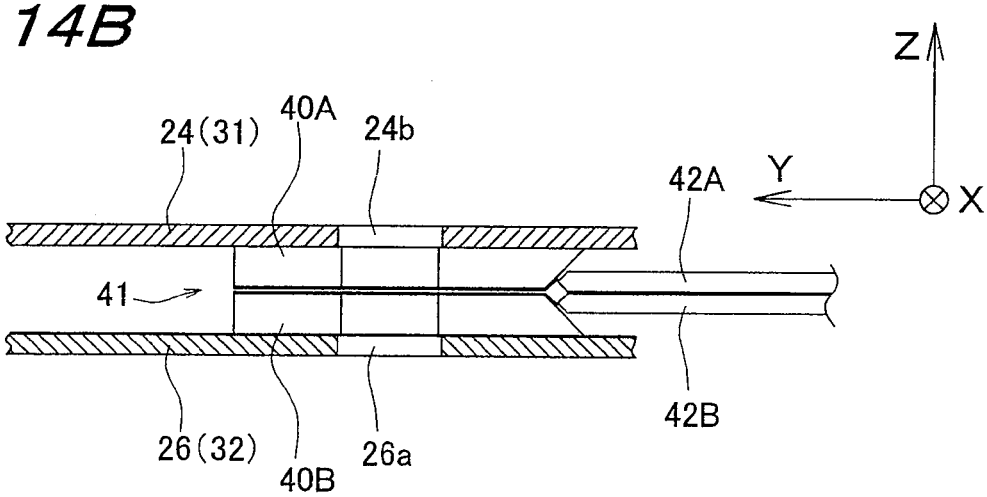
FIG. 14B is a partial sectional view showing the connecting section of the waste toner box and cleaning device when the shutters of the cleaning device and waste toner box are in an open position.

The waste toner box 26 is a box for storing therein the waste toner collected by the cleaning device 23. The waste toner box 26 has a waste side toner reception opening 26*a* opened upward in a region positioned under the waste side toner delivery opening 24*b* of the cleaning device 24 at the time of its attachment to the process unit 31. A conveying screw 26*b* is placed near the lower side of the waste side toner reception opening 26*a*. With reference to FIGS. 14A and 14B, sealing members 40A and 40B similar to those of the development side toner delivery opening 25*a* and the development side toner reception opening 23*b* are attached to the waste side toner delivery opening 24*b* and the waste side toner reception opening 26*a*, respectively. In the state that the toner box unit 32 is attached to the process unit 31, the waste side toner delivery opening 24*b*, the waste side toner reception opening 26*a*, and the sealing members 40A and 40B function as a connecting section 41 which is a passage of the toner from the cleaning device 24 to the waste toner box 26.

The process unit 32 includes a shutter (cleaning device side shutter) 42A which opens and closes the waste side toner delivery opening 24*b* of the cleaning device 24. Similarly, the waste toner box 26 includes a shutter (waste toner box side shutter) 42B which opens and closes the waste side toner reception opening 26*a*. By retracting these shutters 42A and 42B from between the sealing member 40A and 40B, the connecting section 41 can be opened so that the waste side toner delivery opening 24*b* and the waste side toner reception opening 26*a* is communicated with each other. The shutters 42A and 42B as well as the mechanism for driving these shutters will be described in detail later.

The region near the development side toner delivery opening 25*a* of the new toner box 25 and the region near the waste side toner reception opening 26*a* of the waste toner box 26 constitute an insertion section 43 to be inserted into the reception space 37 provided on the process unit 31 side. The toner box unit 32 is detachably attached to the process unit 31 by inserting the insertion section 43 into the reception space 37 and mounting the bottom side of the new toner box 25 on the above-mentioned pedestal section 34.

Description is now given of the shutters 38A and 38B which open and close the development side toner delivery opening 25*a* and the development side toner reception opening 23*b*, as well as the drive mechanism (first shutter drive mechanism) therefor.

Figure 7A:
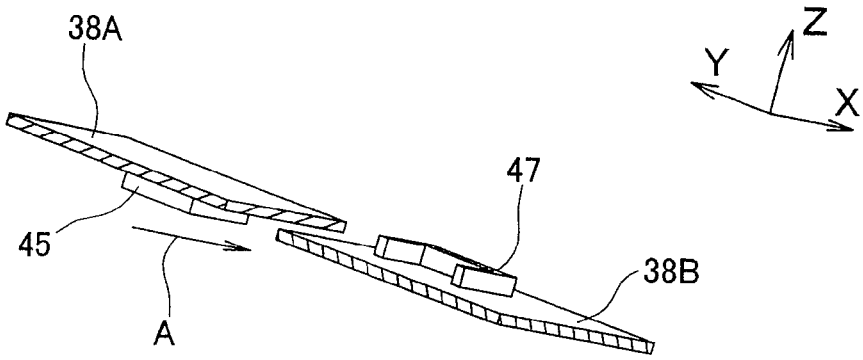
FIG. 7A is a schematic perspective view showing shutters of the new toner box and developing device before being coupled.
Figure 7B:
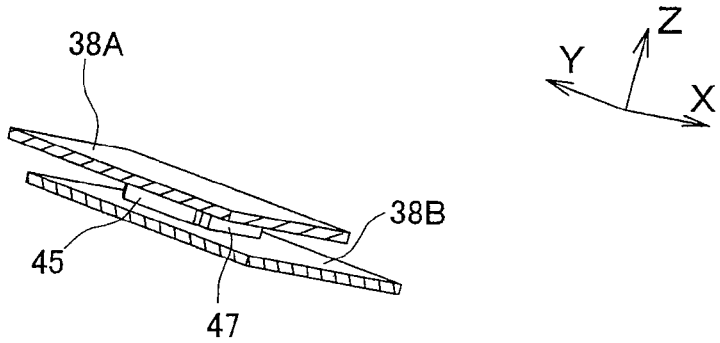
FIG. 7B is a schematic perspective view showing the shutters of the new toner box and developing device after being coupled.
Figure 8:
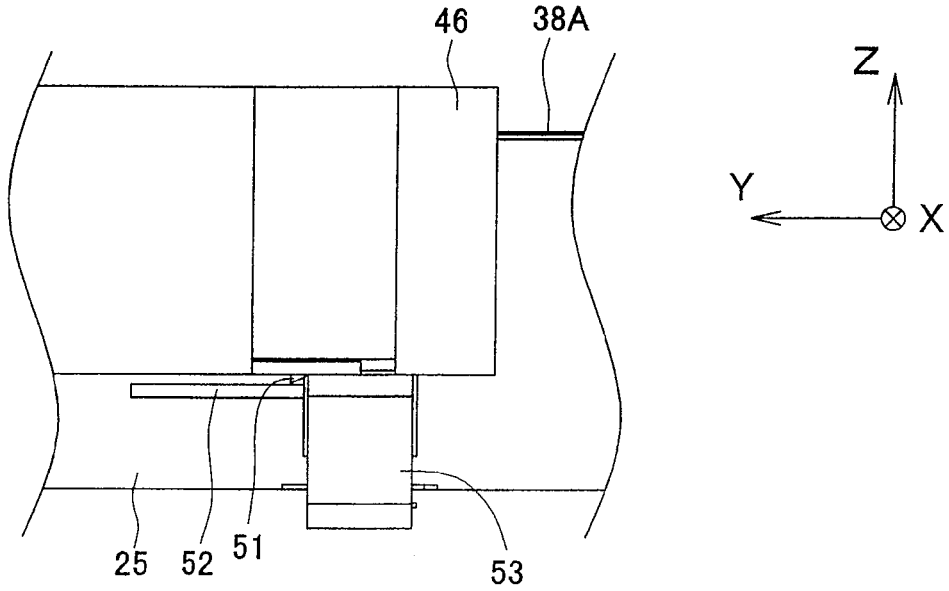
FIG. 8 is a partial plan view showing the vicinity of a control lever of the new toner box.
Figure 9:
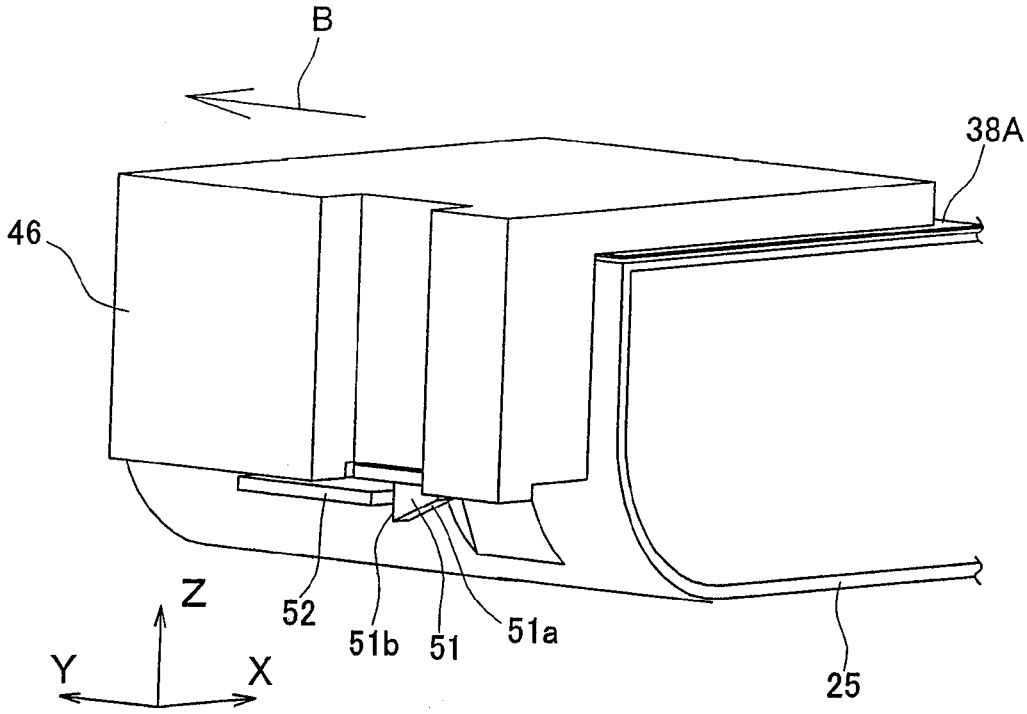
FIG. 9 is a partial perspective view showing the vicinity of the control lever of the new toner box.

The shutter 38A of the development side toner delivery opening 25*a* is slidably attached to the new toner box 25. The sliding direction of the shutter 38A is a direction approximately perpendicular to the attachment direction of the toner box unit 32 to the process unit 31 (an arrow "A" in FIG. 4 and FIG. 7A), i.e., a width direction of the process unit 31 and the toner box unit 32 (Y axis direction). As shown in FIGS. 7A and 7B, a coupling protrusion section 45 is provided on a lower surface of the distal end side of the shutter 38A. The proximal end side of the shutter 38A is coupled to a control lever 46 for manual operation. The distal end side of the control lever 46 is coupled to the proximal end side of the shutter 38A on the upper surface of the new toner box 25, while the proximal end side of the control lever 46 is positioned in a lateral section of the new toner box 25 opposite to the insertion section 43. Therefore, it becomes possible to access to the control lever 46 even when the toner box unit 32 is attached to the process unit 31.

The shutter 38B of the development side toner reception opening 23*b* is slidably attached to the developing device 23. The sliding direction of the shutter 38B on the developing device 23 side is identical to the sliding direction of the shutter 38A on the new toner box 25 side. Moreover, a coupling recess section 47 is provided on the upper surface side of the shutter 38B.

With reference to FIGS. 4, 7A and 7B, when the toner box unit 31 is inserted into the process unit 31, the coupling protrusion section 45 of the shutter 38A on the new toner box 25 side fits into the coupling recess section 47 on the developing device 23 side, by which the shutters 38A and 38B are removably coupled to each other. As a result, the shutters 38A and 38B can move, in the width direction of the toner box unit 32 and the process unit 31 (Y axis direction), between a position which closes the development side toner delivery opening 25*a* and the development side toner reception opening 23*b*, i.e., a close position (FIG. 11A) which blocks movement of the toner through the connecting section 37 of the new toner box 25 and the developing device 23, and a position which opens the development side toner delivery opening 25*a* and the development side toner reception opening 23*b*, i.e., an open position (FIG. 11B) which allows movement of the toner through the connecting section 37.

A locking mechanism shown below is provided which enables the control lever 46 to be operated only when the toner box unit 32 is attached to the process unit 31. With reference to FIG. 8 to FIG. 10E, a lock claw 51 projecting downward is provided on the proximal end side of the control lever 46. An engagement face 51*a* to be engaged with the end face of a lock plate 52 which projects from the new toner box 25 is formed in one lateral section of the lock claw 51. Also, an inclined face 51*b* is formed on the other lateral section of the lock claw 51. A lock releasing lever 53 is attached to the vicinity of the distal end of the pedestal section 34 of the process unit 31. The lock releasing lever 53 can rotate around a revolving shaft extending in the direction (Y axis direction) perpendicular to the attachment direction of the toner box unit 32 to the process unit 31 (arrow "A" in FIG. 4). One end of the lock releasing lever 53 constitutes a lock releasing section 53*a* which is positioned in a lateral section of the new toner box 25 when the toner box unit 32 is attached to the process unit 31. The other end of the lock releasing section 53*a* constitutes a fixed section 53*b* which is to be positioned on the bottom of the new toner box 25 when the toner box unit 32 is attached to the process unit 31. A pin member 54 movable only in the attachment direction of the toner box unit 32 to the process unit 31 (X axis direction) is held in the vicinity of the distal end of the pedestal section 34 of the process unit 31. A concave 25*b* for housing the fixed section 53*b* of the lock releasing lever 53 and the pin member 54 is formed on the bottom of the new toner box 25.

Description is now given of the shutters 42A and 42B which open and close the waste side toner delivery opening 24*b* and the waste side toner reception opening 26*a* as well as the drive mechanism (second shutter drive mechanism) therefor.

Figure 12A:
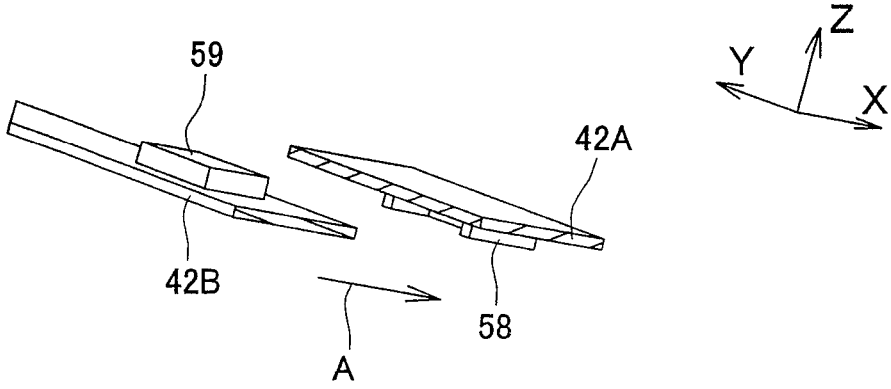
FIG. 12A is a schematic perspective view showing the shutters of the cleaning device and waste toner box before being coupled.
Figure 12B:
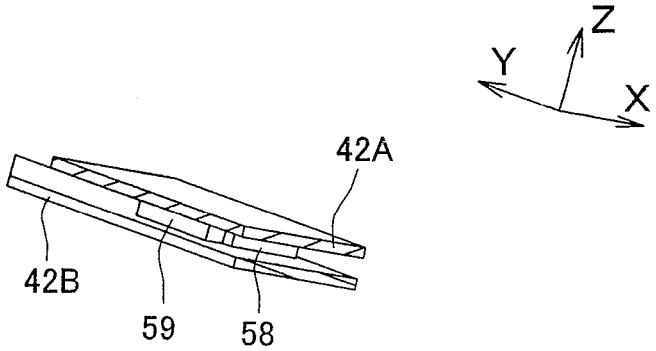
FIG. 12B is a schematic perspective view showing the shutters of the cleaning device and waste toner box after being coupled.

The shutter 42A of the waste side toner delivery opening 24*b* is slidably attached to the cleaning device 24. The sliding direction of the shutter 42A, similar to that of the above-mentioned shutters 38A and 38B, is a direction approximately perpendicular to the attachment direction of the toner box unit 32 to the process unit 31, i.e., a width direction of the process unit 31 and the toner box unit 32. As shown in FIGS. 12A and 12B, a coupling recess section 58 is provided on the lower surface of the shutter 42A.

Figure 13A:
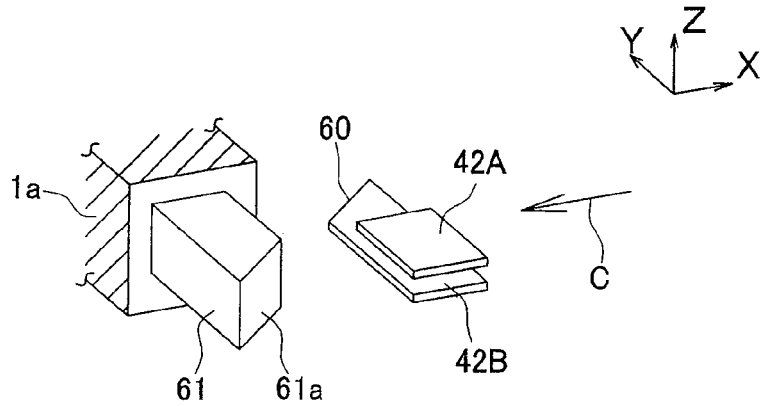
FIG. 13A is a schematic perspective view showing the shutters of the cleaning device and waste toner box before coming into contact with a fixed cam section.
Figure 13B:
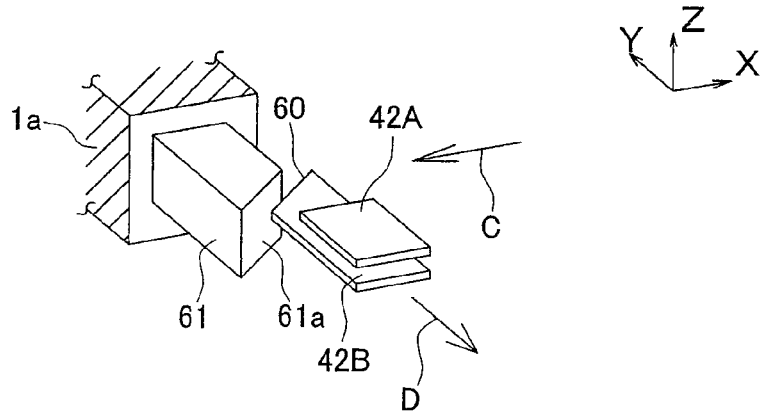
FIG. 13B is a schematic perspective view showing the shutters of the cleaning device and waste toner box at the time of starting movement to an open position upon coming into contact with the fixed cam section.
Figure 13C:
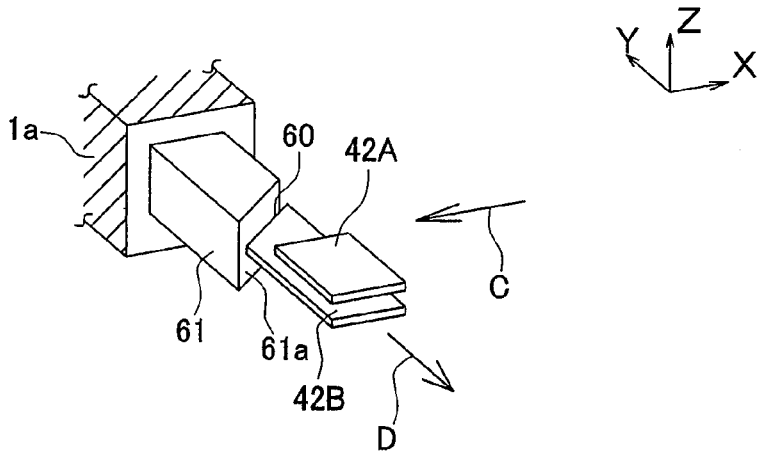
FIG. 13C is a schematic perspective view showing the shutters of the cleaning device and waste toner box during movement to the open position upon coming into contact with the fixed cam section.

The shutter 42B of the waste side toner reception opening 26*a* is slidably attached to the waste toner box 26. The sliding direction on the waste toner box 26B side is identical to the sliding direction of the shutter 42A on the cleaning device 24 side. Moreover, a coupling protrusion section 59 is provided on the upper surface side of the shutter 42A. Further, a cam follower face (a cam follower section) 60 which is constituted of an inclined face is formed in one end section of the shutter 42A. As shown in FIGS. 13A to 13C, in the apparatus body 1*a* of the image forming apparatus 1, a fixing cam member 61 which projects in the width direction (Y axis direction) is placed in the vicinity of a predetermined loading position of the imaging cartridge 4. A fixing cam face (fixed cam section) 61*a* constituted of an inclined face is formed at the distal end of the fixing cam member 61. The cam follower face may be formed not in the shutter 42A but in the shutter 42B, or the cam follower face may be formed in both the shutters 42A and 47B.

With reference to FIGS. 4, 12A and 12B, the coupling protrusion section 59 of the shutter 42B on the waste toner box 26 side fits into the coupling recess section 58 on the cleaning device 24 side, by which the shutters 42A and 47B are removably coupled to each other. As a result, the shutters 42A and 47B can move integrally, in the width direction of the toner box unit 32 and the process unit 31 (Y axis direction), between a position which closes the waste side toner delivery opening 24*b* and the waste side toner reception opening 26*a*, i.e., a close position (FIG. 14A) which blocks movement of the toner through the connecting section 41 of the cleaning device 24 and the waste toner box 26, and a position which opens the waste side toner delivery opening 24*a* and the waste side toner reception opening 23*b*, i.e., an open position (FIG. 14B) which allows movement of the toner through the connecting section 41.

Description is now given of the procedures for attaching the toner box unit 32 to the process unit 31 and further loading the imaging cartridge 4 onto the apparatus main frame 1*a*.

First, as shown by arrow "A" in FIG. 4, in order to attach the toner box unit 32 to the process unit 31, the insertion section 43 of the toner box unit 32 is inserted into the reception space 33 of the process unit 31.

Figure 10A:
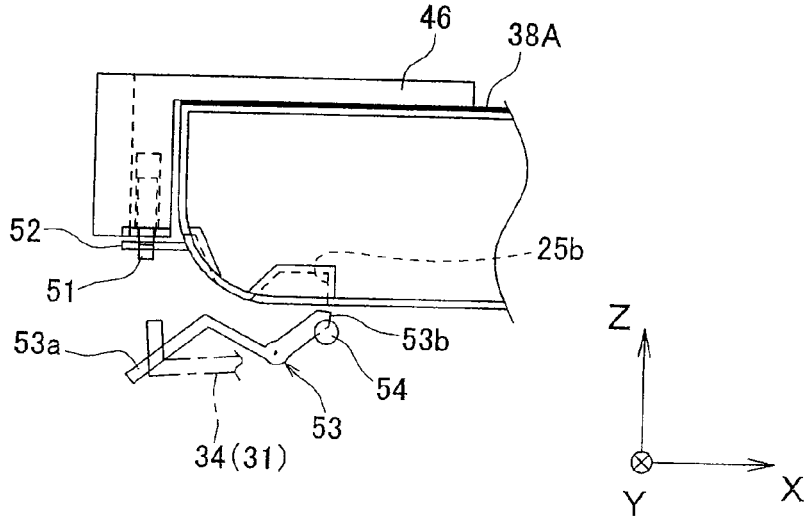
FIG. 10A is a partial sectional view showing operation in the vicinity of the control lever during attachment of the toner box unit to the process unit.
Figure 10B:
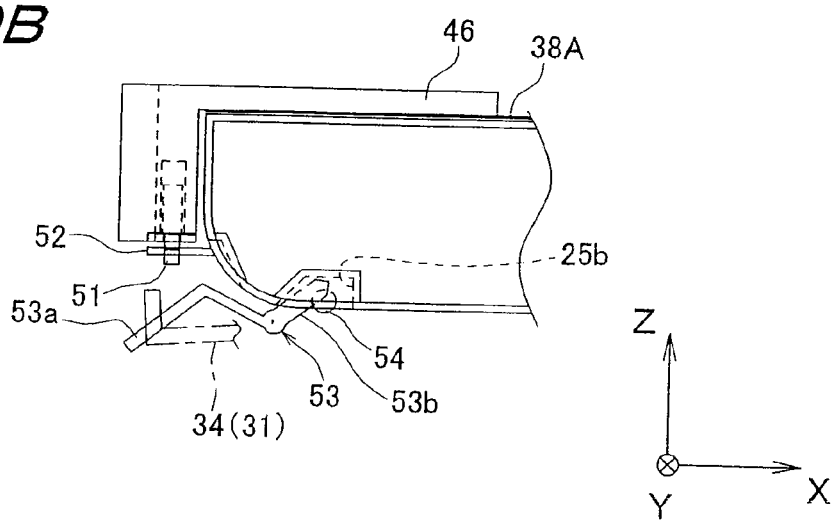
FIG. 10B is a partial sectional view showing operation in the vicinity of the control lever during attachment of the toner box unit to the process unit.
Figure 10C:
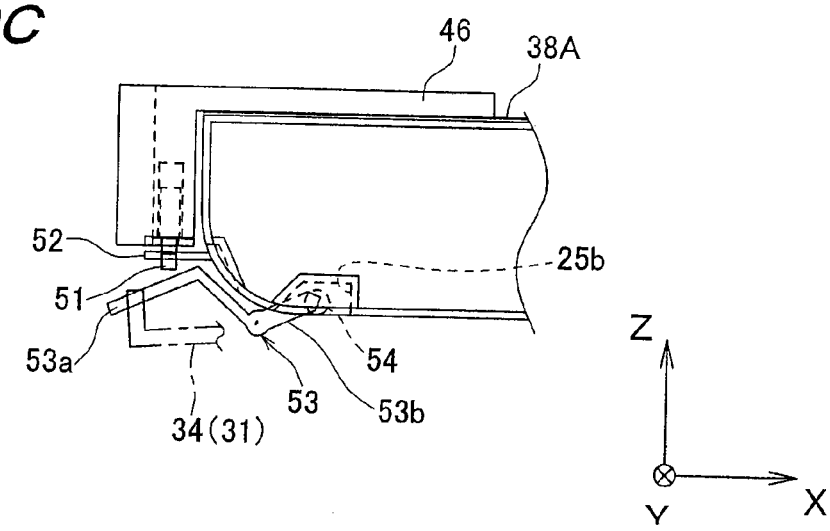
FIG. 10C is a partial sectional view showing operation in the vicinity of the control lever during attachment of the toner box unit to the process unit.
Figure 10D:
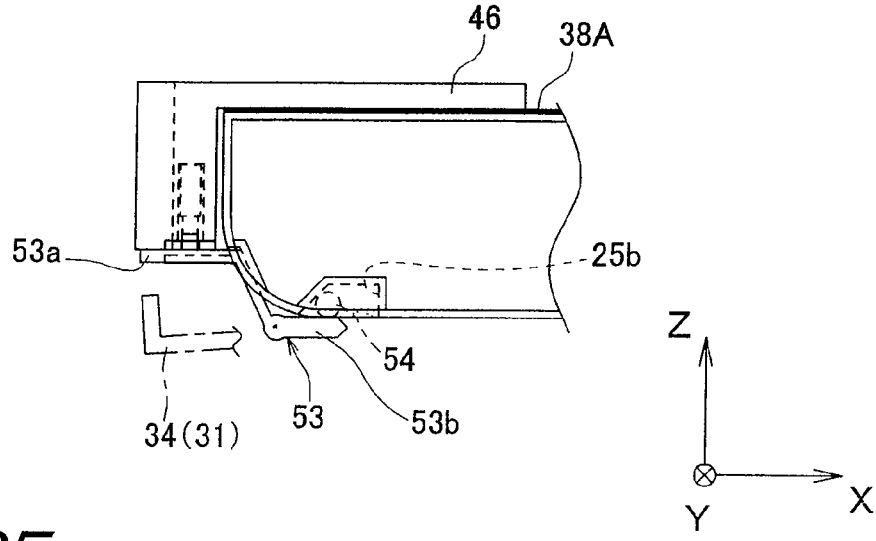
FIG. 10D is a partial sectional view showing operation in the vicinity of the control lever during attachment of the toner box unit to the process unit.
Figure 10E:
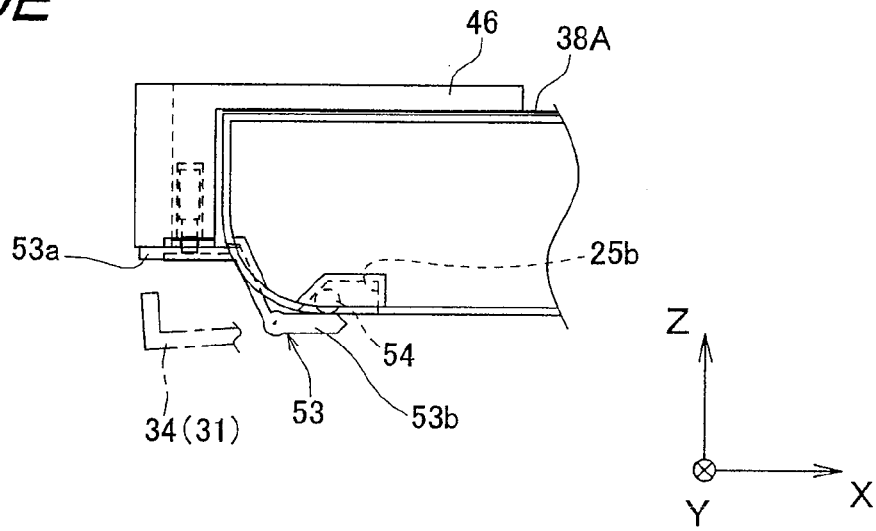
FIG. 10E is a partial sectional view showing operation in the vicinity of the control lever during attachment of the toner box unit to the process unit.

When the toner box unit 32 is in the state of being detached from the process unit 31, the engagement face 51*a* of the lock claw 51 of the control lever 46 is engaged with a lateral face of the lock plate 52, so that the control lever 46 is held in a prescribed position (a position where the shutter 37A is at a close position). As the toner box unit 32 is inserted into the process unit 31, first the fixed section 53*b* of the lock releasing lever 53 and the pin member 54 enter into the concave 25*b* in the new toner box 25 (FIGS. 10A and 10B). In this case, the pin member 54 is positioned below the fixed section 53*b* of the lock releasing lever 53. As the toner box unit 32 is inserted further, the fixed section 53*b* is pushed by the edge of the concave 25*b*, which rotates the lock releasing lever 53 clockwise in the drawings (FIGS. 10B and 10C). As a result, the pin member 54 moves around the distal end of the fixed section 53*b* toward the upper side of the fixed section 53*b* (FIGS. 10D and 10E). With the fixed section 53*b* being interposed between the fixed section 53 and the bottom of the concave 25*b*, the lock releasing lever 53 maintains a posture being rotated clockwise to some extent. With the lock releasing lever 53 in this posture, the lock releasing section 53*a* can push the lock claw 51 of the control lever 46 upward, so that the lower end of the lock claw 51 goes up to the upper surface of the lock plate 52. As a result, the control lever 46 becomes movable in the direction shown by arrow "B" in FIG. 9.

Upon completion of attachment of the toner box unit 32 to the process unit 31, the shutter 38A on the new toner box 25 side and the shutter 38B on the developing device 23 side are coupled to each other (FIG. 7B), while the shutter 42A on the cleaning device 24 side and the shutter 42B on the waste toner box 26 side are coupled to each other (FIG. 7A).

By manually operating the control lever 46 after the attachment of the toner box unit 32 to the process unit 31 is completed, the shutters 38A and 38B are moved from the close position (FIG. 7A) to the open position (FIG. 7B). Thus, after the attachment of the toner box unit 32 to the process unit 31 and before loading of the imaging cartridge 4 into the apparatus body 1*a*, the shutters 38A and 38B can be moved to the open position by manual operation of the control lever 46, by which the connecting section 37 of the new toner box 25 and the developing device 23 can be opened. Therefore, toner starts to move from the new toner box 25 to the developing device 23 through the opened connecting section 37 before loading of the imaging cartridge into the apparatus body 1*a* is completed. As a result, it becomes possible to reduce the time to replenish the developing device 23 with toner after loading the imaging cartridge 4 into the apparatus body 1*a*.

Moreover, as mentioned above, before the attachment of the toner box unit 32 to the process unit 31 is completed, the control lever 46 is not movable as it is locked by the lock claw 51 being engaged with the lock plate 52, which makes it possible to prevent the toner delivery opening 25*a* of the new toner box 25 from being opened before attachment to the process unit 31 and thereby makes it possible to prevent leakage and scattering of the toner from the new toner box 25.

Once the attachment of the toner box unit 32 to the process unit 31 is completed, as mentioned above, the shutters 42A and 42B on the cleaning device 24 side and the waste toner box 26 side are coupled to each other. However, in the state where the imaging cartridge 4 is unloaded from the apparatus body 1*a*, the shutters 42A and 42B are held in the close position, which prevents leakage and scattering of the toner from the connecting section 41 of the cleaning device 24 and the waste toner box 26 (the waste side toner delivery opening 24*b* and the waste side toner reception opening 26*a*).

Next, as shown by arrow "C" in FIGS. 13A to 13C, the imaging cartridge 4 is loaded into the apparatus body 1*a*. When the imaging cartridge 4 is in the process of being moved to a prescribed position in the apparatus body 1*a*, the shutters 42A and 42B on the cleaning device 24 side and the waste toner box 26 side move to open the connecting section 41 of the cleaning device 24 and the waste toner box 26. As the imaging cartridge 4 is inserted into the apparatus body 1*a*, the cam follower face 60 of the shutter 42A comes into contact with a fixing cam face 61*a* of the fixing cam member 61 on the apparatus body 1*a* side (FIGS. 13A and 13B). As the imaging cartridge 4 is inserted further, the cam follower face 60 is pushed by the cam face 61*a*, so that as shown by arrow "D", the shutters 42A and 42B move in the width direction of the imaging cartridge 4 (Y axis direction) from the close position toward the open position (FIGS. 13B and 13C). When the imaging cartridge 4 reaches a prescribed position in the apparatus body 1*a*, the shutters 42A and 42B reach the open position, where the connecting section 41 of the cleaning device 24 and the waste toner box 26 is opened Thus, since the shutters 42A and 42B move from the close position to the open position when the imaging cartridge 4 is in the process of being moved to the prescribed position in the apparatus body 1*a*, it becomes possible to ensure prevention of leakage and scattering of the toner from the connecting section 41 of the cleaning device 24 and the waste toner box 26 during loading and unloading of the imaging cartridge to/from the apparatus body 1*a*.

Figure 15A:
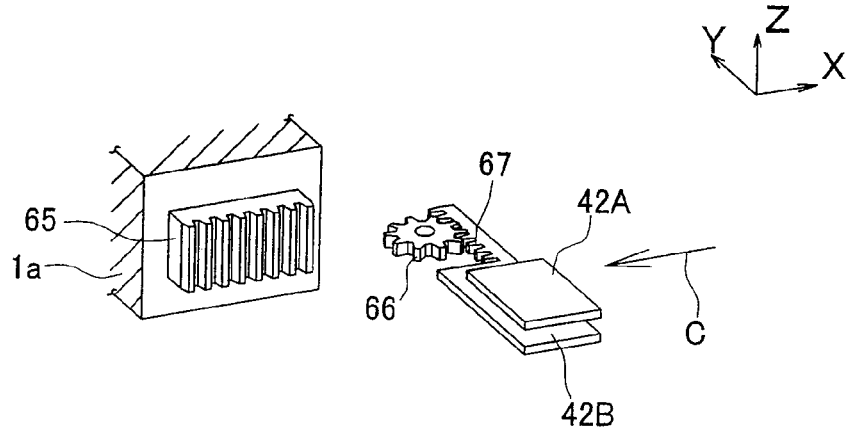
FIG. 15A is a schematic perspective view showing the shutters of the cleaning device and waste toner box before a pinion gears with a fixed rack.
Figure 15B:
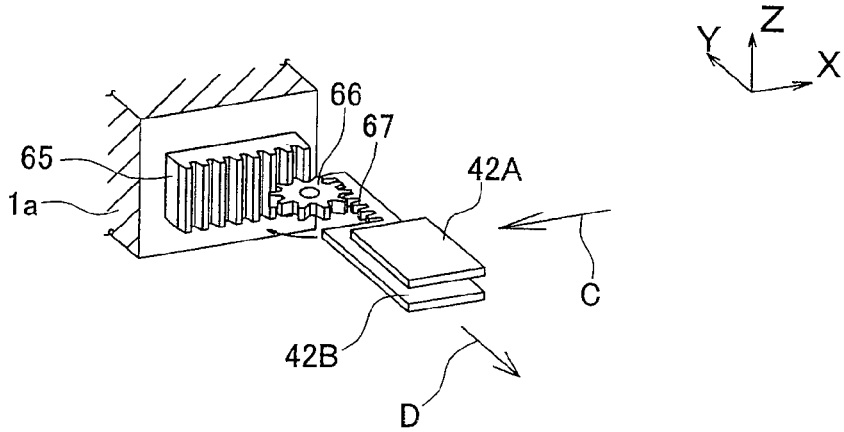
FIG. 15B is a schematic perspective view showing the shutters of the cleaning device and waste toner box at the time of starting movement to the open position upon gearing of the pinion with the fixed rack.
Figure 15C:
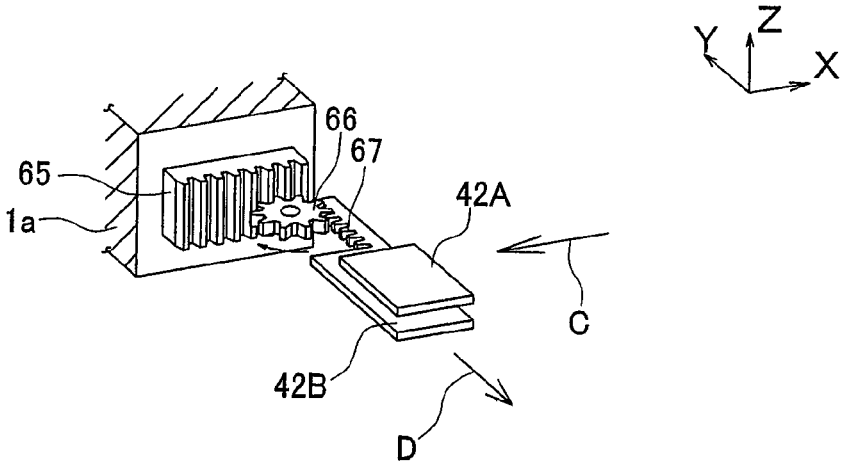
FIG. 15C is a schematic perspective view showing the shutters of the cleaning device and waste toner box during movement to the open position upon gearing of the pinion with the fixed rack.

FIGS. 15A to 15C show an alternative drive mechanism for the shutters 42A and 42B which open and close the waste side toner delivery opening 24*b* and the waste side toner reception opening 26*a*. First, a rack (first rack) 65 is fixed to the apparatus body 1*a* side of the image forming apparatus 1. Moreover, a pinion 66 is supported rotatably around a Z axis on the upper surface side of the waste toner box 26. Further, the shutter 42B on the waste toner box 26*a* side has a rack (second rack) 67 extending in the moving direction of the shutters 42A and 42B (Y axis direction). The rack 67 gears with the pinion 66.

As the imaging cartridge 4 is inserted into the apparatus body 1*a*, the pinion 66 is engaged with the fixed rack 65 (FIGS. 15A and 15B). As the imaging cartridge 4 is inserted further, the pinion 66 rotates by engagement with the rack 65. The rotation of the pinion 66 is converted into a linear motion by engagement of the pinion 66 and the rack 65, and so the shutters 42A and 42B move from the close position toward the open position as shown by arrow "D" (FIGS. 15B and 15C). When the imaging cartridge 4 reaches the prescribed position in the apparatus body 1*a*, the shutters 42A and 42B reach the open position, by which the connecting section 41 of the cleaning device 24 and the waste toner box 26 is opened. Thus, in the case where the alternative shown in FIGS. 15A to 15C is adopted, the shutters 42A and 42B also move from the close position to the open position when the imaging cartridge 4 is in the process of being moved to the prescribed position in the apparatus body 1*a*, which makes it possible to ensure prevention of leakage and scattering of the toner from the connecting section 41 of the cleaning device 24 and the waste toner box 26 during loading and unloading of the imaging cartridge 4 to/from the apparatus body 1*a*. The pinion may be supported not by the waste toner box 26 but by the cleaning device 24. The rack may be provided not in the shutter 42B on the waste toner box 26 side but in the shutter 42A on the cleaning device 24 side.

Figure 16A:
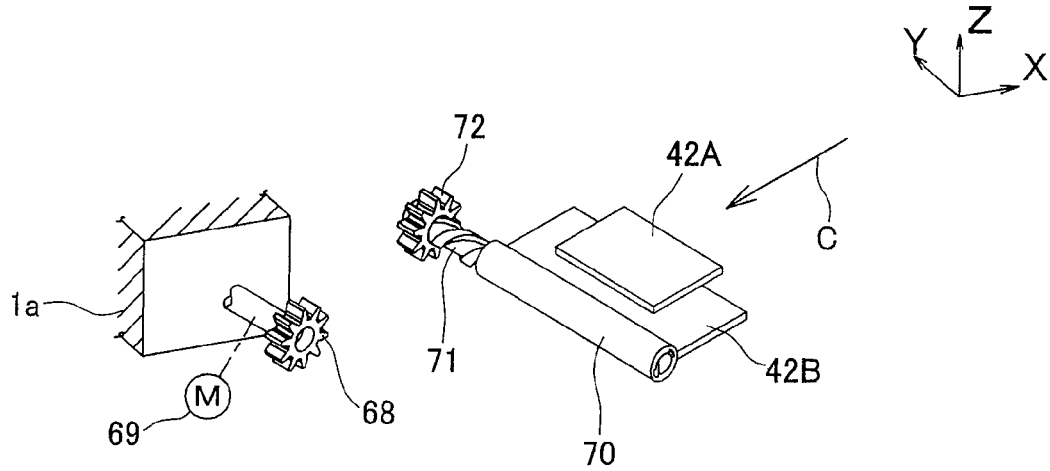
FIG. 16A is a schematic perspective view showing the shutters of the cleaning device and waste toner box before a driving gear gears with a driven gear.
Figure 16B:
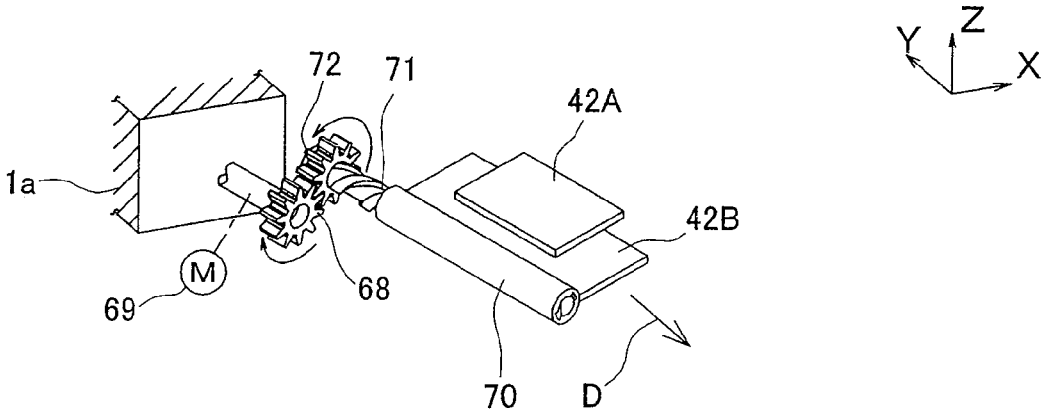
FIG. 16B is a schematic perspective view showing the shutters of the cleaning device and waste toner box during movement to the open position upon transmission of rotation from the driving gear to the driven gear.

FIGS. 16A to 16C show another alternative drive mechanism for the shutters 42A and 42B which open and close the waste side toner delivery opening 24*b* and the waste side toner reception opening 26*a*. First, a driving gear 68 is supported rotatably around a Y axis on the apparatus body 1*a* side of the image forming apparatus 1. The driving gear 68 is rotated by a power source such as a motor schematically shown by a reference numeral 69. A nut section 70 is formed in the shutter 42B on the waste toner box 26 side, and a feed screw 71 is screwed into the nut section 70. A driven gear 72 is fixed to one end of the feed screw 71. The driven gear 72 and the feed screw 71 rotate coaxially.

When the imaging cartridge 4 is in the process of being inserted into the apparatus body 1*a*, the driven gear 72 is not engaged with the driving gear 68 (FIG. 16A). However, once the imaging cartridge 4 completes its movement to a prescribed position in the apparatus body 1*a*, the driven gear 72 is engaged with the driving gear 68. In this state, the driving gear 68 is rotated by the power source 69. Rotation of the driving gear 68 is transmitted to the driven gear 72. The feed screw 71 rotates with the driven gear 72, and the rotation of the feed screw 71 is converted into a linear motion of the nut section 70. As a result, the shutters 42A and 42B move from the close position to the open position as shown by arrow "D". Thus, in the case where the alternative shown in FIGS. 16A to 16C is adopted, the shutters 42A and 42B move from the close position to the open position after the imaging cartridge 4 has moved to the prescribed position in the apparatus body 1*a*, which makes it possible to ensure prevention of leakage and scattering of the toner from the connecting section 41 of the cleaning device 24 and the waste toner box 26 during loading and unloading of the imaging cartridge 4 to/from the apparatus body 1*a*. The combination of the feed screw and the nut section may be provided not in the shutter 42B on the waste toner box 26 but in the shutter 42A on the cleaning device 24 side.

The present invention is not limited to the embodiments disclosed but includes various modifications. Although the present invention has been explained regarding the printer of the direct transfer type, the present invention can also be applied to image forming apparatuses of indirect transfer type in which a toner image is primarily transferred onto an intermediate transfer belt from respective imaging cartridges and the toner image on the intermediate transfer belt is secondarily transferred onto a recording medium. The present invention is also applicable to image forming apparatuses other than printers, such as copying machines, facsimile machines, and multi-functional machines.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. An imaging cartridge detachably loaded into an image forming apparatus body, comprising:

a process unit comprising at least an image bearing body, a developing device adapted to develop an electrostatic latent image on the image bearing body to form a toner image, and a cleaning device adapted to collect toner remaining on the image bearing body after transfer of the toner image;

a toner box unit integrally comprising a new toner box adapted to store unused toner to be fed to the developing device and a waste toner box adapted to store waste toner collected by the cleaning device, the toner box unit being detachably attached to the process unit;

a first shutter mechanism movable in a linear motion to a close position which blocks movement of the toner through a first connecting section between the new toner box and developing device and an open position which permits the movement of the toner through the first connecting section;

a second shutter mechanism movable to a close position which blocks movement of the toner through a second connecting section between the waste toner box and cleaning device and an open position which permits the movement of the toner through the second connecting section;

a first shutter drive mechanism adapted to enable the first shutter mechanism to be moved between the close position and open position by manual operation when the process unit with the toner box unit attached thereto is out of the image forming apparatus body; and a second shutter drive mechanism adapted to move the second shutter mechanism from the close position to the open position during movement of the process unit with the toner box unit attached thereto to a predetermined position in the image forming apparatus or after completion of the movement to the predetermined position.

2. An imaging cartridge according to claim 1, wherein the first shutter mechanism comprises:

a new toner box side shutter provided in the new toner box and adapted to be movable in an opening and closing direction perpendicular to an attachment direction of the toner box unit to the process unit; and a developing device side shutter provided in the developing device and adapted to be movable in the opening and closing direction, wherein upon attachment of the toner box unit to the process unit, the new toner box side shutter and developing device side shutter are removably coupled to each other so as to be moved together in the opening and closing direction between the close position and open position.

3. An imaging cartridge according to claim 2, wherein the first shutter drive mechanism comprises a manual operation member coupled to the new toner box side shutter.

4. An imaging cartridge according to claim 3, wherein the first shutter drive mechanism further comprises:

a locking mechanism adapted to lock the manual operation member in a predetermined position when the toner box unit is in a state of being detached from the process unit; and a lock release mechanism adapted to release the lock by the locking mechanism to allow the manual operation member to be moved when the toner box unit is attached to the process unit.

5. An imaging cartridge according to claim 1, wherein the second shutter mechanism comprises:

a waste toner box side shutter provided in the waste toner box and adapted to be movable in an opening and closing direction perpendicular to an attachment direction of the toner box unit to the process unit; and a cleaning device side shutter provided in the cleaning device and adapted to be movable in the opening and closing direction, wherein upon attachment of the toner box unit to the process unit, the waste toner box side shutter and cleaning device side shutter are removably coupled to each other so as to be moved together in the opening and closing direction between the close position and the open position.

6. An imaging cartridge according to claim 5, wherein the second shutter drive mechanism comprises:

a fixed cam section provided on the image forming apparatus body side; and a cam follower section provided at least either in the waste toner box side shutter or the cleaning device side shutter, the cam follower section being pressed by the fixed cam section as the process unit with the toner box unit attached thereto is inserted into the image forming apparatus body so that the waste toner box side shutter and cleaning device side shutter are moved together toward the open position.

7. An imaging cartridge according to claim 5, wherein the second shutter drive mechanism comprises:

a first rack fixed to the image forming apparatus body side;

a pinion rotatably supported by the waste toner box or cleaning device; and a second rack provided in the waste toner box side shutter or cleaning device side shutter and constantly engaged with the pinion.

8. An imaging cartridge according to claim 5, wherein the second shutter drive mechanism comprises:

a driving gear arranged on the image forming apparatus body side;

a feed screw screwed into a nut section provided in the waste toner box side shutter or cleaning device side shutter; and a driven gear fixed to the feed screw so as to be rotated coaxially with the feed screw;

wherein upon completion of movement of the process cartridge with the toner box unit attached thereto to the predetermined position in the image forming apparatus, the driven gear is engaged with the driving gear, and the rotation transmitted from the driving gear to the driven gear is converted into a linear motion by the feed screw and the nut section, so that the waste toner box side shutter and cleaning device side shutter move.

9. An image forming apparatus, including the imaging cartridge according to claim 1.

10. An imaging cartridge detachably loaded into an image forming apparatus body, comprising:

a process unit comprising at least an image bearing body, a developing device adapted to develop an electrostatic latent image on the image bearing body to form a toner image, and a cleaning device adapted to collect toner remaining on the image bearing body after transfer of the toner image;

a toner box unit integrally comprising a new toner box adapted to store unused toner to be fed to the developing device and a waste toner box adapted to store waste toner collected by the cleaning device, the toner box unit being detachably attached to the process unit;

a first shutter mechanism movable to a close position which blocks movement of the toner through a first connecting section between the new toner box and developing device and an open position which permits the movement of the toner through the first connecting section;

a second shutter mechanism movable to a close position which blocks movement of the toner through a second connecting section between the waste toner box and cleaning device and an open position which permits the movement of the toner through the second connecting section;

a first shutter drive mechanism adapted to enable the first shutter mechanism to be moved between the close position and open position by manual operation when the process unit with the toner box unit attached thereto is out of the image forming apparatus body; and a second shutter drive mechanism adapted to move the second shutter mechanism from the close position to the open position during movement of the process unit with the toner box unit attached thereto to a predetermined position in the image forming apparatus or after completion of the movement to the predetermined position, wherein the second shutter mechanism comprises a waste toner box side shutter provided in the waste toner box and adapted to be movable in an opening and closing direction perpendicular to an attachment direction of the toner box unit to the process unit, and a cleaning device side shutter provided in the cleaning device and adapted to be movable in the opening and closing direction, wherein upon attachment of the toner box unit to the process unit, the waste toner box side shutter and cleaning device side shutter are removably coupled to each other so as to be moved together in the opening and closing direction between the close position and the open position, and wherein the second shutter drive mechanism comprises a fixed cam section provided on the image forming apparatus body side, and a cam follower section provided at least either in the waste toner box side shutter or the cleaning device side shutter, the cam follower section being pressed by the fixed cam section as the process unit with the toner box unit attached thereto is inserted into the image forming apparatus body so that the waste toner box side shutter and cleaning device side shutter are moved together toward the open position.

11. An imaging cartridge detachably loaded into an image forming apparatus body, comprising:

a process unit comprising at least an image bearing body, a developing device adapted to develop an electrostatic latent image on the image bearing body to form a toner image, and a cleaning device adapted to collect toner remaining on the image bearing body after transfer of the toner image;

a toner box unit integrally comprising a new toner box adapted to store unused toner to be fed to the developing device and a waste toner box adapted to store waste toner collected by the cleaning device, the toner box unit being detachably attached to the process unit;

a first shutter mechanism movable to a close position which blocks movement of the toner through a first connecting section between the new toner box and developing device and an open position which permits the movement of the toner through the first connecting section;

a second shutter mechanism movable to a close position which blocks movement of the toner through a second connecting section between the waste toner box and cleaning device and an open position which permits the movement of the toner through the second connecting section;

a first shutter drive mechanism adapted to enable the first shutter mechanism to be moved between the close position and open position by manual operation when the process unit with the toner box unit attached thereto is out of the image forming apparatus body; and a second shutter drive mechanism adapted to move the second shutter mechanism from the close position to the open position during movement of the process unit with the toner box unit attached thereto to a predetermined position in the image forming apparatus or after completion of the movement to the predetermined position, wherein the second shutter mechanism comprises a waste toner box side shutter provided in the waste toner box and adapted to be movable in an opening and closing direction perpendicular to an attachment direction of the toner box unit to the process unit, and a cleaning device side shutter provided in the cleaning device and adapted to be movable in the opening and closing direction, wherein upon attachment of the toner box unit to the process unit, the waste toner box side shutter and cleaning device side shutter are removably coupled to each other so as to be moved together in the opening and closing direction between the close position and the open position, and wherein the second shutter drive mechanism comprises a first rack fixed to the image forming apparatus body side, a pinion rotatably supported by the waste toner box or cleaning device, and a second rack provided in the waste toner box side shutter or cleaning device side shutter and constantly engaged with the pinion.

12. An imaging cartridge detachably loaded into an image forming apparatus body, comprising:

a process unit comprising at least an image bearing body, a developing device adapted to develop an electrostatic latent image on the image bearing body to form a toner image, and a cleaning device adapted to collect toner remaining on the image bearing body after transfer of the toner image;

a toner box unit integrally comprising a new toner box adapted to store unused toner to be fed to the developing device and a waste toner box adapted to store waste toner collected by the cleaning device, the toner box unit being detachably attached to the process unit;

a first shutter mechanism movable to a close position which blocks movement of the toner through a first connecting section between the new toner box and developing device and an open position which permits the movement of the toner through the first connecting section;

a second shutter mechanism movable to a close position which blocks movement of the toner through a second connecting section between the waste toner box and cleaning device and an open position which permits the movement of the toner through the second connecting section;

a first shutter drive mechanism adapted to enable the first shutter mechanism to be moved between the close position and open position by manual operation when the process unit with the toner box unit attached thereto is out of the image forming apparatus body; and a second shutter drive mechanism adapted to move the second shutter mechanism from the close position to the open position during movement of the process unit with the toner box unit attached thereto to a predetermined position in the image forming apparatus or after completion of the movement to the predetermined position, wherein the second shutter mechanism comprises a waste toner box side shutter provided in the waste toner box and adapted to be movable in an opening and closing direction perpendicular to an attachment direction of the toner box unit to the process unit, and a cleaning device side shutter provided in the cleaning device and adapted to be movable in the opening and closing direction, wherein upon attachment of the toner box unit to the process unit, the waste toner box side shutter and cleaning device side shutter are removably coupled to each other so as to be moved together in the opening and closing direction between the close position and the open position, and wherein the second shutter drive mechanism comprises a driving gear arranged on the image forming apparatus body side, a feed screw screwed into a nut section provided in the waste toner box side shutter or cleaning device side shutter, and a driven gear fixed to the feed screw so as to be rotated coaxially with the feed screw, wherein upon completion of movement of the process cartridge with the toner box unit attached thereto to the predetermined position in the image forming apparatus, the driven gear is engaged with the driving gear, and the rotation transmitted from the driving gear to the driven gear is converted into a linear motion by the feed screw and the nut section, so that the waste toner box side shutter and cleaning device side shutter move.

* * * * *